US008693712B2

(12) United States Patent
Sun et al.

(10) Patent No.: US 8,693,712 B2
(45) Date of Patent: Apr. 8, 2014

(54) CONDENSER MICROPHONE

(75) Inventors: Weihua Sun, WeiFang (CN); Wenbin Wei, WeiFang (CN); Rongguo Yao, WeiFang (CN); Xianbin Wang, WeiFang (CN); Maoqiang Dang, WeiFang (CN)

(73) Assignee: Goertek Inc., Weifang (CN)

( * ) Notice: Subject to any disclaimer, the term of this patent is extended or adjusted under 35 U.S.C. 154(b) by 338 days.

(21) Appl. No.: 12/933,318

(22) PCT Filed: Dec. 22, 2009

(86) PCT No.: PCT/CN2009/075833

§ 371 (c)(1), (2), (4) Date: Oct. 27, 2010

(87) PCT Pub. No.: WO2010/072142

PCT Pub. Date: Jan. 7, 2010

(65) Prior Publication Data

US 2011/0044479 A1 Feb. 24, 2011

(30) Foreign Application Priority Data

Dec. 23, 2008 (CN) ..... 2008 2 0232884 U

(51) Int. Cl.
*H04R 25/00* (2006.01)

(52) U.S. Cl.
USPC ..... 381/174; 381/368; 381/369

(58) Field of Classification Search
USPC ..... 381/189, 355, 368–369, 173–174, 396
See application file for complete search history.

(56) References Cited

U.S. PATENT DOCUMENTS 3,947,647 A * 3/1976 Swinehart ..... 381/173
6,128,393 A * 10/2000 Kondo ..... 381/368
6,341,976 B1 * 1/2002 Jakob et al. ..... 439/366
7,286,680 B2 * 10/2007 Steeman et al. ..... 381/369
2004/0190193 A1 * 9/2004 Kuwajima ..... 360/97.01
2008/0267439 A1 * 10/2008 Yonehara et al. ..... 381/355

FOREIGN PATENT DOCUMENTS

CN 1822721 A * 8/2006 ..... H04R 19/01
CN 101257736 A * 9/2008 ..... H04R 19/01
CN 201323651 Y * 10/2009 ..... H04R 19/01

* cited by examiner

*Primary Examiner* — Suhan Ni
(74) *Attorney, Agent, or Firm* — Troutman Sanders LLP

(57) ABSTRACT

The present invention provides a condenser microphone. In one embodiment, the condenser microphone comprises: a frame of the microphone formed of a circuit board substrate and a casing, and an amplifier device, an elastic holding component and capacitance components provided inside the microphone. One or more sound holes are provided on the circuit board substrate or the casing. The capacitance components are provided on the side with the sound holes. The amplifier device is provided on the side opposite to the side with the sound holes. The elastic holding component is provided on the side with the amplifier device or on the side with the capacitance components. The amplifier device and the capacitance components are both electrically connected to the circuit board substrate; and one or more auxiliary supporting parts are provided on the elastic holding component with the vertical height thereof being greater than that of the amplifier device and less than the distance between the capacitance components and the opposite inner wall of the microphone. When the microphone according to the present invention is sharply accelerated or under an impact, a collision between the amplifier device and the backplate caused by excessive deformation of the elastic holding component and a reduction in the resilience of the elastic holding component can be prevented with the help of the auxiliary supporting parts.

13 Claims, 7 Drawing Sheets

Legend:

1: circuit board substrate
2: circuit board frame
3: circuit board bottom plate
4: elastic holding component
5: backplate
6: metal ring
7: isolation spacer
11: amplifier device
12: circuit on the circuit board substrate 1
21: metal filled holes
31: metal layer
32: sound hole
41: frame
42: bending part
43: auxiliary supporting parts
61: vibration diaphragm Legend:

1: circuit board substrate
2: circuit board frame
3: circuit board bottom plate
4: elastic holding component
5: backplate
6: metal ring
7: isolation spacer
11: amplifier device
12: circuit on the circuit board substrate 1
21: metal filled holes
31: metal layer
32: sound hole
41: frame
42: bending part
43: auxiliary supporting parts
61: vibration diaphragm Legend:

41: frame
42: bending part
43: auxiliary supporting parts

Legend:

1: circuit board substrate
2: circuit board frame
3: circuit board bottom plate
4: elastic holding component
5: backplate
6: metal ring
7: isolation spacer
11: amplifier device
41: frame
42: bending part
43: auxiliary supporting parts Legend:

1: circuit board substrate
5: backplate
11: amplifier device
241: frame
242: bending part
243: auxiliary supporting parts Legend:

241: frame
242: bending part
243: auxiliary supporting parts

Legend:

44: connecting parts
241: frame
242: bending part
243: auxiliary supporting parts Legend:

1: circuit board substrate
5: backplate
11: amplifier device
241: frame
242: bending part
243: auxiliary supporting parts

CONDENSER MICROPHONE

BENEFIT CLAIMS

This application is a U.S. National Stage of International Application No. PCT/CN2009/075833 filed 22 Dec. 2009, which claims the benefit of CN200820232884.3, filed 23 Dec. 2008.

FIELD OF THE INVENTION

The present invention relates to the technical field of condenser microphones.

BACKGROUND

As the sizes of internal parts of electronic products such as mobile phones, laptops, hearing aids are becoming smaller and smaller, a large amount of small-size, high-quality and low-cost miniature condenser microphones are being applied. At present, miniature condenser microphones available in the market generally have a volume of tens of cubic millimeters. In view of this size requirement, the traditional design of a miniature condenser microphone, in which the fundamental structure comprises a protection frame composed of a metal casing and a circuit board, a plastic enclosure installed inside the protection frame to play a supporting and insulating role, a metal grating ring mounted inside the enclosure for circuit conduction, and capacitance components connected to the grating ring, will inevitably negatively affect the performances of its products since the sizes and the amounts of the internal parts thereof are both large. There exists a tradeoff between the size and the performances of a product from the viewpoint of technology. Therefore, a newly structured condenser microphone was disclosed in the prior patent CN200710129770.6, wherein a protection structure is composed of a circuit board substrate and a frame body, sound holes for receiving external signals are provided on the protection structure, a vibration diaphragm, an isolation spacer and a backplate are sequentially arranged inside the protection structure, the backplate is kept elastically and electrically connected to the circuit board substrate through an elastic holding component made of spring materials, and the vibration diaphragm may be electrically connected to the circuit board substrate through circuits inside the frame body. The structure of the product can, to some extent, lead to a reduction in the size of the product, however, there exists in the structure a certain gap between the backplate and the inner side walls of the frame body so that the backplate can move freely within the frame body, and its position can only be determined by the elasticity of the elastic holding component. In case that the product stays in a relatively stable state, the backplate can be stably secured by the elastic holding component, and be electrically well-connected to the circuit board substrate. When the product is in a state of sharp acceleration, for example in a falling test, a plurality of drawbacks may appear. For example, a relatively large force may be fully applied to the elastic holding component by the backplate, resulting in a sharp compression that could cause an excessive deformation of the elastic holding component and thus a reduction in the resilience thereof, so that the electrical connection between the circuit board substrate and the backplate may turn out to be unstable or even broken. Moreover, because the amplifier is usually mounted near the central portion of the circuit board substrate, a relatively large force may cause the portion of the substrate where the amplifier is mounted to deform in a direction towards the backplate. This situation may also result in a compression deformation in the elastic holding component, so that a collision between the backplate and the amplifier device may occur and thus lead to various undesirable consequences such as damages to the amplifier device.

Therefore, there is a need to design a newly structured condenser microphone with higher reliability, and make the products thereof thinner and smaller without causing various drawbacks.

SUMMARY

The technical problem to be solved by the present invention is to provide a condenser microphone of higher reliability, while preventing performance degradation and avoiding damages to the product when the microphone is being sharply accelerated or is under an impact.

To solve the above technical problem, the present invention provides a condenser microphone, comprising: a circuit board substrate, a casing fixed to the circuit board substrate, and an amplifier device, an elastic holding component and capacitance components provided inside the microphone, wherein, one or more sound holes are provided on the circuit board substrate or the casing for receiving the external signals; the elastic holding component is provided on the side with the amplifier device or on the side with the capacitance components, with the amplifier device and the capacitance components being both electrically connected to the circuit board substrate, characterized in that:

one or more auxiliary supporting parts are provided on the elastic holding component, with the vertical height of the one or more auxiliary supporting parts being greater than that of the amplifier device and less than the distance between the capacitance components and the opposite inner wall of the microphone.

Preferably, the elastic holding component further comprises one or more frames and one or more bending parts; the capacitance components are kept elastically and electrically connected to the circuit board substrate through the one or more bending parts.

Preferably, the elastic holding component comprises a frame parallel to the plane of the circuit board substrate and a bending part extending from one side of the frame; the one or more auxiliary supporting parts are provided on the frame.

Furthermore, the elastic end portions of the one or more bending parts are provided with a round and smooth shape.

Preferably, the elastic holding part has a curvy and thin toroidal frame structure, the one or more bending parts have a smoothly arched shape, the one or more auxiliary supporting parts are protrusions provided on the one or more frames.

Preferably, the capacitance components comprise a metal ring, a vibration diaphragm, an isolation spacer and a backplate sequentially stacked from the bottom up on the internal surface of the microphone.

Preferably, the backplate is kept elastically and electrically connected to the circuit board substrate through the elastic holding component.

Preferably, the end portions of the one or more frames are connected to the backplate, and the summits of one or more bending parts are connected to the circuit board substrate.

Preferably, the condenser microphone further comprises: one or more metal filled holes provided within the side walls of the casing, and a metal layer provided between the inner surface of the microphone and the metal ring, with the diaphragm being electrically connected to the circuit board substrate through the metal filled holes, the metal layer, and the metal ring in combination.

Preferably, the one or more connecting parts connecting the frames and the bending parts have a smoothly curved shape; a round and smooth protrusion is provided at the summit of each of the arched bending parts; there are provided at least two auxiliary supporting parts symmetrically distributed; and each of the auxiliary supporting parts is an arched protrusion with a plurality of supporting legs.

With the adoption of the above solution, when the condenser microphone is sharply accelerated or under an impact, the internal space of the condenser microphone will be squeezed and the elastic holding component will be compressed under the effect of the acceleration. When the elastic holding component is compressed to some extent, the one or more auxiliary supporting parts will provide a support between the capacitance components and corresponding inner wall of the condenser microphone, so that the internal pressure of the microphone will be transferred to the auxiliary supporting parts, and the amplifier device and the capacitance components will be prevented from coming too close, thus a collision between the amplifier device and the backplate caused by excessive deformation of the elastic holding component can be avoided and, at the same time, a reduction in the resilience of the elastic holding component caused by excessive deformation thereof can be prevented.

BRIEF DESCRIPTION OF THE DRAWINGS

The foregoing and other features and advantages of the invention will be apparent and more easily understood from the following description of exemplary embodiments of the present invention with reference to the appended drawings.

DETAILED DESCRIPTION

Thereinafter, the present invention will be further explained in details with reference to the appended drawings and specific embodiments.

The First Embodiment

Figure 1:
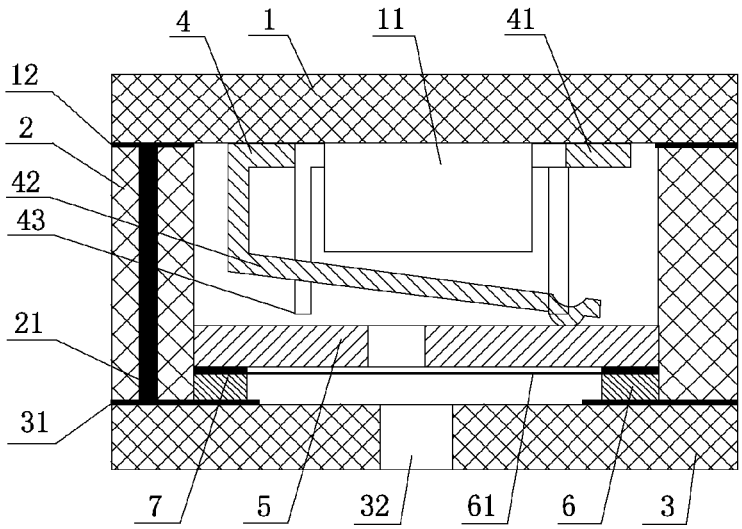
FIG. 1 is a schematic diagram illustrating the structure of the condenser microphone according to the first embodiment of the present invention.

FIG. 1 is a schematic diagram illustrating the structure of the condenser microphone according to the first embodiment of the present invention. As shown in FIG. 1, the external contour and the internal structure of the condenser microphone according to the first embodiment may both have a rectangular shape, a check-box-like circuit board frame 2 and a rectangular circuit board bottom plate 3 provided with sound holes 32 form a casing, and the casing and a rectangular circuit board substrate 1 provided with an amplifier device 11 are combined to form a sandwich-like protection structure.

Capacitance components and an elastic holding component 4 may be installed inside the protection structure, with the capacitance components being installed on the side with the sound holes within the microphone and being electrically connected to the circuit board substrate 1 on the opposite side, and the elastic holding component 4 being installed on the side with the amplifier device 11.

As shown in FIG. 1, the capacitance components comprise, from the top down, a backplate 5, an isolation spacer 7, a vibration diaphragm 61 and a metal ring 6 used for fixing the diaphragm 61, wherein the isolation spacer 7 is provided between the backplate 5 and the diaphragm 61 so as to form a plate condenser, and the backplate 5 and the diaphragm 6 are separately electrically connected to the circuit board substrate.

Figure 2:
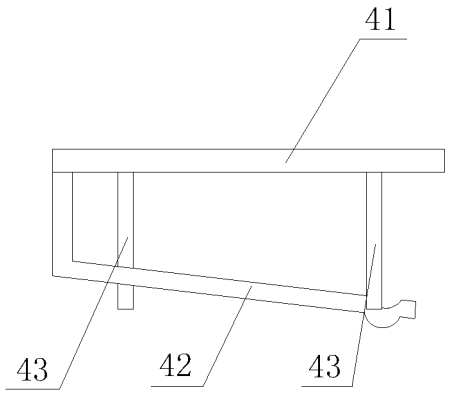
FIG. 2 is a schematic diagram illustrating the structure of the elastic holding component according to the first embodiment of the present invention.

FIG. 2 is a schematic diagram illustrating the structure of the elastic holding component according to the first embodiment. As shown in FIG. 2, the elastic holding component 4 may comprise a frame 41 and a bending part 42, wherein the frame 41 may be installed on the circuit board substrate 1 and encircle the amplifier device 11, and the bending part 42 comes into elastic contact with the backplate 5. Also, the frame 41 may be integrally provided with two symmetrically distributed auxiliary supporting parts 43, which may be perpendicular to the plane of the frame 41, have a column shape, and be located around the amplifier device 11, with the vertical height thereof larger than that of the amplifier device 11 and less than the distance between the circuit board substrate 1 and the backplate 5 when there is no impact being applied to the microphone.

Figure 3:
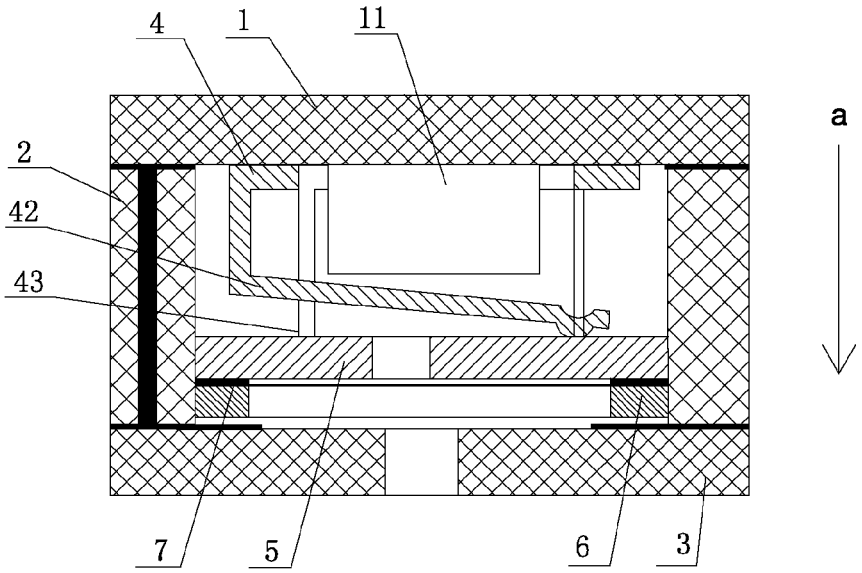
FIG. 3 is a schematic diagram illustrating the structure, under an impact caused by acceleration, of the condenser microphone according to the first embodiment of the present invention.

Upon the installation of the elastic holding component 4 inside the condenser microphone, the lower ends of the one or more auxiliary supporting parts 43 have no contact with the backplate 5, but are closer to the backplate 5 than the amplifier device 11. When the condenser microphone is accelerated in a direction "a" shown in the FIG. 3, the bending part 42 of the elastic holding component 4 may deform under the impact caused by the backplate 5, and the distance between the backplate 5 and the amplifier device 11 may decrease rapidly. However, when the distance between the backplate 5 and the amplifier device 11 is equal to the vertical height of the one or more auxiliary supporting parts 43, the backplate 5 will come into contact with the one or more auxiliary supporting parts 43 and be supported thereby, so as to prevent a collision between the backplate 5 and the amplifier device 11, and avoid an excessive deformation of the bending part 42 of the elastic holding component 4, which may cause a decrease in resilience and thus raise a risk of circuit disconnections inside the microphone products.

The capacitance components according to the present invention can be electrically connected to the circuit board substrate 1 by a variety of means. In the first embodiment, electrically conducting metal filled holes 21 may be provided in the circuit board frame 2, and a metal layer 31 may be provided between the inner surface of the microphone and the metal ring 6 and extend to the metal filled holes 21, so that the diaphragm 61 can be electrically connected to the circuit board substrate 1 through the metal filled holes 21, the metal layer 31 on the circuit board bottom plate 3, and the metal ring 6 in combination. That is, the diaphragm 61 may be electrically connected to the circuit 12 on the circuit board substrate 1 through the metal ring 6, the metal layer 31 on the circuit board bottom plate 3, and the metal filled holes 21 provided in the circuit board frame 2. At the same time, the backplate 5 may be electrically connected to the circuit board substrate 1 through the bending part 42 of the metal made elastic holding component 4 provided in the microphone.

In the first embodiment, the metal filled holes provided in the circuit board frame 2 may be formed by a process of drilling holes in the circuit board materials.

In the first embodiment, the elastic holding component 4 comprises a frame 41 parallel to the plane of the circuit board substrate and a bending part 42 extending from one side of the frame 41 and perpendicular to the plane of the frame 41, wherein the one or more auxiliary supporting parts 43 are perpendicularly provided on the frame 41 so that they may be securely supported and thus may play a supporting role better; the frame 41 is attached to the circuit board substrate 1, the bending part 42 is attached to the backplate 5, and the structure and the circuit connections are more stable.

On the other hand, it is also possible that the frame 41 may be attached to the backplate 5 and the bending part 42 be attached to the circuit board substrate 1, which result in a reduction in the parallel area between the elastic holding component 4 and the circuit board substrate 1, and thus result in a reduction of the parasite capacitances.

Furthermore, now that the bending part 42 may offer an elastic and electrical connection between the backplate 5 and the circuit board substrate 1, in order to guarantee the quality of the electrical connection, the elastic end portion of the bending part 42 may be designed to be round and smooth, so that the round and smooth convex point of the end portion may be used to achieve an electrical connection to the backplate or to the circuit board substrate.

As for how the elastic holding component 4 is installed, it can be flexibly designed according to the requirements of actual products. The one or more auxiliary supporting parts 43 may adopt a column shape and form an integral structure with the elastic holding component 4. The one or more auxiliary supporting parts 43 may be designed to be one supporting part so as to simplify the manufacturing process and reduce the costs, alternatively, the one or more auxiliary supporting parts 43 may be designed to be a plurality of supporting parts symmetrically distributed so as to achieve a stable structure and a good supporting effect.

Furthermore, it should be noted that the external structure of the condenser microphone according to the first embodiment comprises a casing, which further comprises a circuit board frame 2 and a circuit board bottom plate 3; and a circuit board substrate 1. However, those skilled in the art will understand that there may be a variety of ways to package or implement the external structure of the condenser microphone, and the position of the circuit board, the configuration of the sound holes and the positions for installing the amplifier device and the capacitance components may be flexibly designed according to the requirements of production, installation and usage. Therefore, the condenser microphone according to the first embodiment may be implemented in various other ways, and is not intended to limit the present invention to such a specific technical solution.

The Second Embodiment

Figure 4:
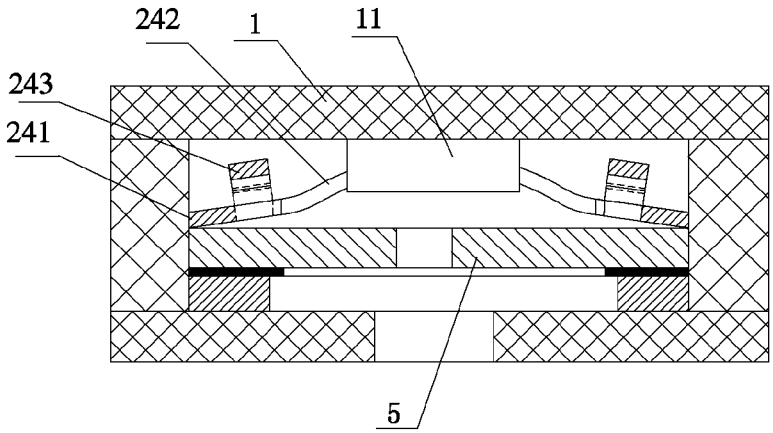
FIG. 4 is a schematic diagram illustrating the structure of the condenser microphone according to the second embodiment of the present invention.
Figure 5:
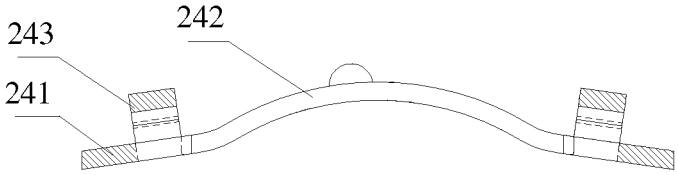
FIG. 5 is a schematic diagram illustrating the structure of the elastic holding component according to the second embodiment of the present invention.
Figure 6:
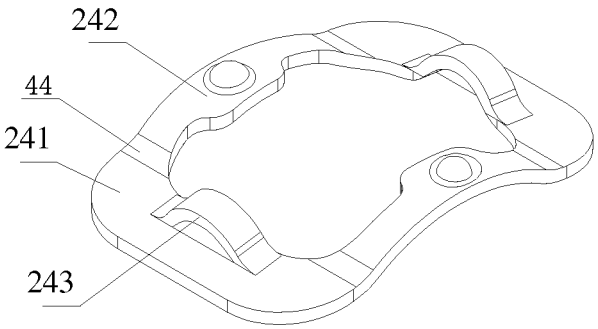
FIG. 6 is a perspective view illustrating the elastic holding component according to the second embodiment of the present invention.

FIG. 4, FIG. 5 and FIG. 6 are schematic diagrams illustrating, respectively, the whole structure and partial structure of the condenser microphone according to the second embodiment of the present invention. As shown in FIG. 4, FIG. 5 and FIG. 6, the second embodiment is different from the first embodiment in the installation position and the structure design of the elastic holding component 4.

In the second embodiment, the frame 241 of the elastic holding component 4 may be installed on the backplate 5 of the capacitance components instead of being installed on the side provided with amplifier device 11 as is in the first embodiment. When the elastic holding component deforms and reaches its limit position under an impact applied to the microphone, the one or more auxiliary supporting parts 243 may stand as well between the backplate and the inner wall of the microphone provided with the amplifier device. The effects of installing the elastic holding component at different positions differ in that the touching points of the ends of the one or more auxiliary supporting parts are different, and while the touching points of the ends of the one or more auxiliary supporting parts are on the backplate 5 in the first embodiment, they are on the circuit board substrate 1, i.e. the inner wall of the microphone provided with the amplifier device 11, in the second embodiment. Furthermore, the installation manner may reduce the parallel area between the elastic holding component 4 and the circuit board substrate 1, and thus reduces the parasite capacitances.

Also, in the second embodiment, the elastic holding component 4 may has a curvy and thin toroidal frame structure, as shown in FIG. 5 and FIG. 6 which illustrate a schematic structural view and a perspective schematic view, respectively.

As shown in FIG. 5 and FIG. 6, the elastic holding component 4 may comprise roughly flat frames 241, bending parts 242, connecting parts 244 connecting the frames 241 and the bending parts 242, and auxiliary supporting parts 243. The frames 241, the bending parts 242 and the connecting parts 244 integrally form an arched structure of a certain arch height (as shown in FIG. 5), and the toroidal frame structure formed by the frames 241, the bending parts 42 and the connecting parts 244 has a central hollow region slightly greater in size than the amplifier device 11 so that the toroidal frame structure may surround the amplifier device 11.

An auxiliary supporting part 243 may be an arched protrusion with a plurality of supporting legs and be integrally provided on the frame 241 of the elastic holding component 4, with the vertical height of the auxiliary support part 243 being greater than that of the amplifier device 11 and less than the distance between the circuit board substrate 1 and the backplate 5 when there is no impact being applied to the microphone.

The elastic holding component 4 of the toroidal frame structure according to the second embodiment may surround the amplifier device 11 and thus may sufficiently utilize the internal space of the condenser microphone, so that the size of the condenser microphone can be further reduced. Also, the elastic holding component of the curvy and thin toroidal frame structure has good stability and elasticity, and is more suitable for small-sized products.

Furthermore, the connecting parts 244 connecting the frames 241 and the bending parts 242 may have a smoothly curved shape and thus guarantee a better elastic effect. Each auxiliary supporting part 243 may be an arched protrusion with a plurality of supporting legs and thus have a stable structure. In comparison with the elastic holding component of the first embodiment, the same of the second embodiment may be integrally formed by processes such as stamping, and thus the overall manufacturing process may be simpler and the resulting costs may be lower.

Figure 7:
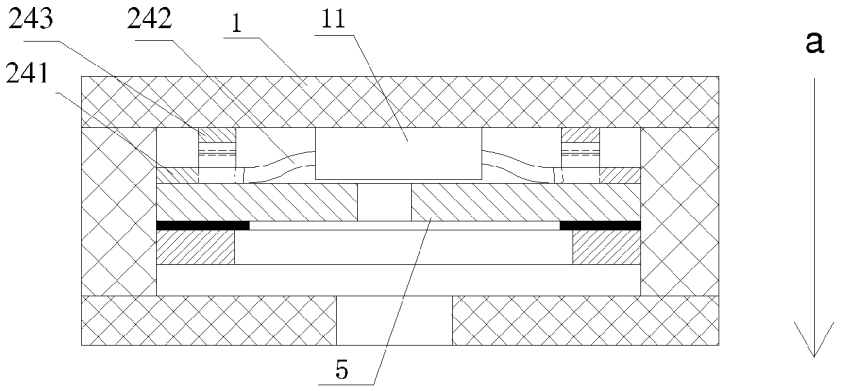
FIG. 7 is a schematic diagram illustrating the structure, under an impact caused by acceleration, of the condenser microphone according to the second embodiment of the present invention.

FIG. 7 is a schematic diagram illustrating the structure, under an impact caused by acceleration, of the condenser microphone according to the second embodiment. As shown in FIG. 7, when the condenser microphone is accelerated in a direction "a", the bending parts 242 of the elastic holding component 4 may deform under the impact caused by the backplate 5, and the distance between the backplate 5 and the amplifier device 11 may decrease rapidly. However, when the distance between the backplate 5 and the amplifier device 11 is equal to the vertical height of the one or more auxiliary supporting parts 243, the circuit board substrate 1 will come into contact with the one or more auxiliary supporting parts 243 and be supported thereby, so as to prevent a collision between the backplate 5 and the amplifier device 11, and avoid an excessive deformation of the bending parts 242 of the elastic holding component 4, which may cause a decrease in resilience and thus raise a risk of circuit disconnections inside the microphone products.

In the present invention, the one or more auxiliary supporting parts may also be convex points formed by stamping on the elastic holding component, or be protrusions of a certain height formed with other design and manufacture methods to achieve the same effect, only if the vertical height thereof is greater than that of the amplifier device 11 and less than the distance between the circuit board substrate 1 and the backplate 5 when there is no impact applied to the microphone. Furthermore, since the elastic holding component according to the second embodiment may have a toroidal frame structure, it is preferable to design at least two auxiliary supporting parts symmetrically distributed, so as to maintain the load balance under a pressure force and thus maintain the best supporting effect.

Furthermore, now that the bending parts 242 may offer an elastic and electrical connection between the backplate 5 and the circuit board substrate 1, in order to guarantee the quality of the electrical connection, round and smooth protrusions are provided at the summits of the arched bending parts 242, so that the round and smooth convex points may be used to achieve an electrical connection to the backplate or to the circuit board substrate.

Similarly, in the second embodiment, the capacitance components may be electrically connected to the circuit board substrate 1 by a variety of ways such as the electrical connection method of the first embodiment, auxiliary circuits and so on. The available electrical connection methods may be flexibly chosen according to the actual product requirements in view of the present inventive concept without departing from the scope of the present invention. Furthermore, there may be a variety of ways to package or implement the external frame of the condenser microphone, and the position of the circuit board, the configuration of the sound holes and the positions for installing the amplifier device and the capacitance components may be flexibly designed according to the requirements of production, installation and usage, and should not be limited to the concrete technical solution according to the second embodiment In view of the above teachings of the present invention, those skilled in the art can make various modifications and variations based on the above embodiments, which fall within the scope of the present invention. It should be understood by those skilled in the art that the above detailed description is intended to better explain the purposes of the present invention, and the scope of the present invention is defined by the claims and their equivalents.

What is claimed is:

1. A condenser microphone, comprising:

a circuit board substrate, a casing fixed to the circuit board substrate, and an amplifier device, an elastic holding component and capacitance components provided inside the microphone, wherein one or more sound holes are provided on the circuit board substrate or the casing for receiving the external signals;

the elastic holding component is provided on the side with the amplifier device or on the side with the capacitance components, wherein the amplifier device and the capacitance components are both electrically connected to the circuit board substrate;

one or more rigid auxiliary supporting parts are provided on the elastic holding component, wherein the vertical height of the one or more auxiliary supporting parts is greater than that of the amplifier device and less than the distance between the capacitance components and the opposite inner wall of the microphone.

2. A condenser microphone according to claim 1, wherein, the elastic holding component further comprises one or more frames and one or more bending parts; and the capacitance components are kept elastically and electrically connected to the circuit board substrate through the one or more bending parts.

3. A condenser microphone according to claim 1, wherein, the elastic holding component comprises a frame parallel to the plane of the circuit board substrate and a bending part extending from one side of the frame; and one or more auxiliary supporting parts are provided on the frame.

4. A condenser microphone according to claim 2 or claim 3, wherein, the elastic end portions of the one or more bending parts are provided with a round and smooth shape.

5. A condenser microphone according to claim 2, wherein, the elastic holding component has a curvy and thin toroidal frame structure, the one or more bending parts have a smoothly arched shape, and the one or more auxiliary supporting parts are protrusions provided on the one or more frames.

6. A condenser microphone according to claim 1 or claim 2 or claim 3, wherein, the capacitance components comprise a metal ring, a vibration diaphragm, an isolation spacer and a backplate sequentially stacked from the bottom up on the internal surface of the microphone.

7. A condenser microphone according to claim 1, wherein, the backplate is kept elastically and electrically connected to the circuit board substrate through the elastic holding component.

8. A condenser microphone according to claim 7, wherein, the end portions of the one or more frames are connected to the backplate, and the summits of one or more bending parts are connected to the circuit board substrate.

9. A condenser microphone according to claim 1, further comprising:

one or more metal filled holes provided within the side walls of the casing, and a metal layer provided between the inner surface of the microphone and the metal ring, wherein the diaphragm is electrically connected to the circuit board substrate through the metal filled holes, the metal layer, and the metal ring in combination.

10. A condenser microphone according to claim 5, wherein, the one or more connecting parts connecting the frames and the bending parts have a smoothly curved shape.

11. A condenser microphone according to claim 5, wherein, a round and smooth protrusion is provided at the summit of each of the arched bending parts.

12. A condenser microphone according to claim 5, wherein, the one or more auxiliary supporting parts comprise at least two auxiliary supporting parts symmetrically distributed.

13. A condenser microphone according to claim 5, wherein, each of the auxiliary supporting parts is an arched protrusion with a plurality of supporting legs.

* * * * *